US005560293A

United States Patent [19]

Boreali et al.

[11] Patent Number: 5,560,293

[45] Date of Patent: Oct. 1, 1996

[54] LINERLESS LABEL PRINTER AND TRANSPORT SYSTEM

[75] Inventors: Jeffrey J. Boreali, North Tonawanda; Thomas P. Nash, Getzvill; Stephen Michalovic, Williamsville; Myron C. Heeb, W. Seneca, all of N.Y.

[73] Assignee: Moore Business Forms, Inc., Grand Island, N.Y.

[21] Appl. No.: 484,875

[22] Filed: Jun. 7, 1995

Related U.S. Application Data

[63] Continuation-in-part of Ser. No. 312,068, Sep. 26, 1994, abandoned.

[51] Int. Cl.[6] ..... B41F 1/08

[52] U.S. Cl. ..... 101/288; 400/621

[58] Field of Search ..... 101/66, 288, 420, 101/421; 156/354, 361, 364; 400/621, 641, 662

[56] References Cited

U.S. PATENT DOCUMENTS

| | | |
|---|---|---|
| 2,639,830 | 5/1953 | Weimont . |
| 3,159,521 | 12/1964 | Pechmann . |
| 3,783,058 | 1/1974 | Solomon et al. . |
| 3,891,492 | 6/1975 | Watson . |
| 3,938,698 | 2/1976 | McDavid, Jr. et al. . |
| 4,035,808 | 7/1977 | Karp . |
| 4,124,429 | 11/1978 | Crankshaw . |
| 4,288,280 | 9/1981 | Morin . |
| 4,295,915 | 10/1981 | Sakaguchi et al. . |
| 4,440,248 | 4/1984 | Teraoka . |
| 4,468,274 | 8/1984 | Adachi . |
| 4,502,804 | 3/1985 | Willcox . |
| 4,590,497 | 5/1986 | Shibata et al. . |
| 4,595,447 | 6/1986 | Lindstrom . |
| 4,706,096 | 11/1987 | Sato . |
| 4,707,211 | 11/1987 | Shibata . |
| 4,712,114 | 12/1987 | Kikuchi . |
| 4,784,714 | 11/1988 | Shibata . |
| 4,886,566 | 12/1989 | Peyre . |
| 4,957,378 | 9/1990 | Shima . |
| 4,980,009 | 12/1990 | Goodwin et al. . |
| 4,981,378 | 1/1991 | Krämer . |
| 4,985,096 | 1/1991 | Bekker-Madsen . |
| 5,159,350 | 10/1992 | Minaminaka . |
| 5,292,713 | 3/1994 | Stenzel et al. . |
| 5,324,153 | 6/1994 | Chess . |
| 5,375,752 | 12/1994 | Michalovic . |

FOREIGN PATENT DOCUMENTS

| | | |
|---|---|---|
| 0577241 | 1/1994 | European Pat. Off. . |

*Primary Examiner*—Christopher A. Bennett
*Attorney, Agent, or Firm*—Nixon & Vanderhye

[57] ABSTRACT

A thermal printer prints linerless labels in such a way that printer components will not stick to the adhesive face of linerless labels. Substantially stationary printer components, such as a label guide, transport plate, front panel, and stripper blade, preferably have the adhesive face engaging surfaces thereof plasma coated so that adhesive will not stick to them. An optional cutter provided downstream of the stripper blade also has plasma coated surfaces. A driven platen roller has a surface thereof coated with or covered by a high release silicone, which will not stick to the adhesive, but has high friction characteristics to facilitate drive of the labels. In a direct thermal printer, a plasma coated tear off surface is downstream of the driven platen roller, and stripper belts, a second roller with O-rings, and the like are provided to prevent the labels from wrapping around the driven platen roller. One or more sensors may also be provided for controlling drive of the platen roller in response to the position of registration marks on the linerless labels.

20 Claims, 6 Drawing Sheets

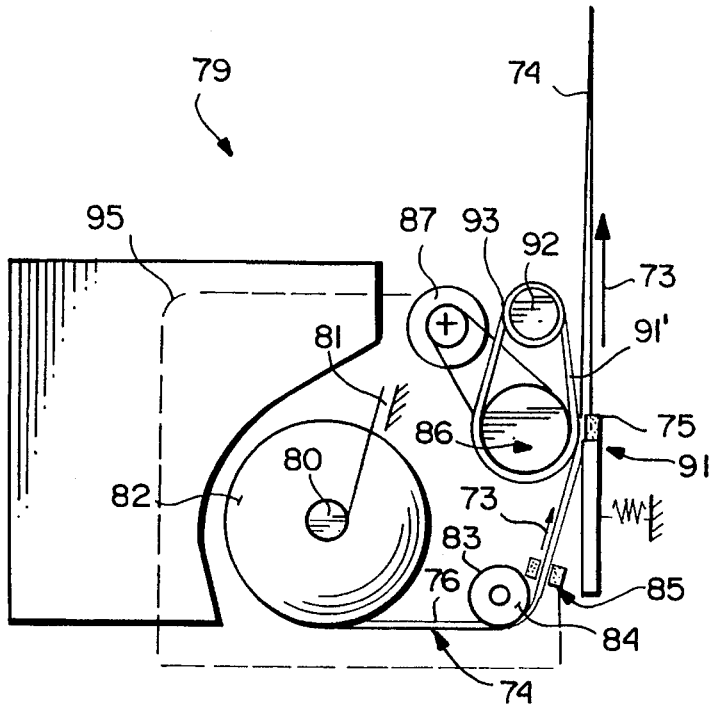
FIG. 12
FIG. 13
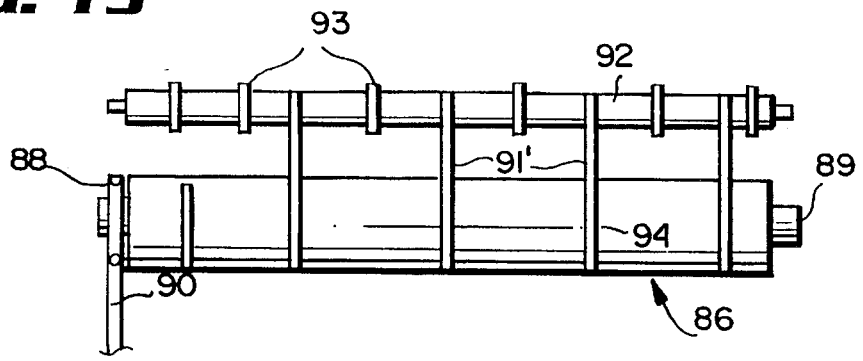
FIG. 14
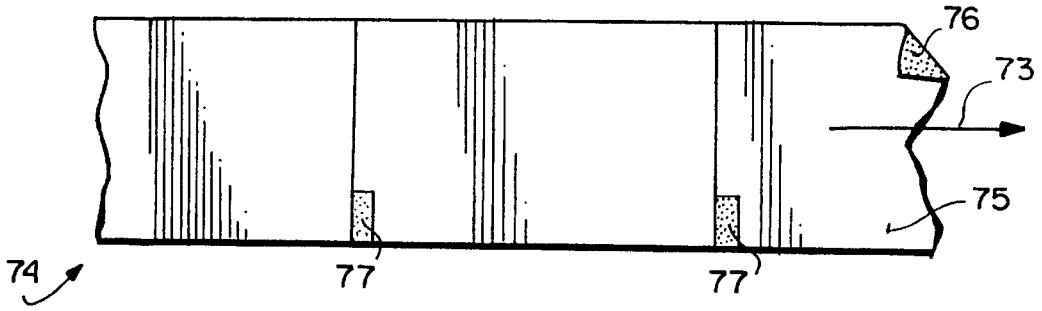

LINERLESS LABEL PRINTER AND TRANSPORT SYSTEM

RELATED APPLICATIONS

This application is a continuation-in-part of application Ser. No. 8/312,068, filed Sep. 26, 1994, abandoned, the disclosure of which is incorporated herein by reference.

BACKGROUND AND SUMMARY OF THE INVENTION

Linerless labels are becoming increasingly more popular because of the advantages associated therewith. When linerless labels are utilized it is necessary to be able to automatically print the labels in a cost-effective manner. One way that this can readily be accomplished is by utilizing a thermal printer, either a thermal printer having a thermal printhead with a thermal ribbon unwind and rewind system, or a thermal printer with a direct thermal printhead. Conventional thermal printers are not capable of printing linerless labels, however, because there will be surfaces thereof which necessarily come into contact with the uncovered adhesive face of the linerless labels as the labels are being fed to the printhead, during printing, or afterwards. According to the present invention, however, a variety of thermal printers are provided which overcome this problem and are eminently suited for effective printing of linerless labels. The linerless labels printed according to the present invention may—in the thermal ribbon embodiment—be almost any type of linerless labels, such as shown in U.S. Pat. No. 5,354,588 issued from Ser. No. 07/912,851 filed Jul. 13, 1992 (the disclosure of which is incorporated by reference herein). In the direct thermal printer embodiment of the invention, the linerless labels preferably are such as shown in U.S. Pat. No. 5,292,713 (the disclosure of which is incorporated by reference herein).

According to one aspect of the present invention a thermal printer for printing linerless labels, having an uncovered adhesive face, is provided comprising the following elements: A linerless label unwind. A substantially stationary label guide. A substantially stationary transport plate. A rotatable driven platen roller. A printhead cooperating with the print roller. And, the label guide and transport plate having surfaces which engage the adhesive face of linerless labels from the label unwind, the adhesive-engaging surfaces comprising plasma coated surfaces which substantially prevent the label adhesive from adhering thereto. The printhead preferably comprises a thermal printhead, and a thermal printer unwind and rewind system is associated with the printhead that provides the thermal ribbon between the printhead and the driven platen roller.

The driven platen roller preferably has a peripheral surface thereof which is coated with a high release silicone which has both non-stick characteristics with respect to the adhesive face of the linerless labels, but also high friction characteristics to facilitate driving of the labels. Any other substantially stationary surfaces of the printer which are also likely to come into contact with the adhesive face of the linerless labels—such as a front panel— are also plasma coated. The transport plate may be grooved to minimize the surface area that engages the label adhesive face.

The printer also preferably comprises a stripper blade/bridge mounted on the opposite side of the driven platen roller from the label unwind, in the direction of label conveyance through the printer. The stripper blade/bridge is positioned with respect to the driven platen roller and the printhead so as to prevent a printed label from being wound onto the driven platen roller and assists the label moving from the platen roller to the cutter. The stripper blade/bridge has a surface which has a non-stick feature, preferably a plasma coating, and typically the stripper blade/bridge may be mounted directly on a pre-existing tear bar on the printer.

According to the invention a conventional thermal printer may readily be modified merely by substituting the particular non-stick label guide, transport plate, and driven platen roller according to the invention, and mounting the stripper blade/bridge on the existing tear bar.

According to another aspect of the present invention a thermal printer for linerless labels is provided comprising: A label unwind for mounting a roller of linerless labels. A driven platen roller having a peripheral surface constructed so that it will not stick to adhesive from the linerless label adhesive face. A printhead cooperating with the platen roller and disposed on the opposite side thereof from a linerless label printed thereby. And a tear off bar disposed on the opposite side of the platen roller from the label unwind, the tear off bar having a surface which will not stick to the adhesive a linerless label torn off thereby. The tear off bar preferably has a plasma coating, and the driven platen roller has a high release silicone covering, as described above.

According to this aspect of the invention the printer also preferably comprises stripper belts and a second roller having surface manifestations (preferably O-rings) on the opposite side of the printhead from the label unwind in the path of linerless label movement, to prevent a printed label from winding onto the driven platen roller. The printhead preferably comprises a direct thermal printhead. At least one sensor is also typically provided mounted on the printer for sensing registration marks on linerless labels and controlling drive of the platen roller in response to sensing of the registration marks so that each label is printed and then printer action stops until that label is torn off, at which time driving and printing action resumes.

It is the primary object of the present invention to provide an effective printer (preferably a thermal printer) for printing linerless labels. This and other objects of the invention will become clear from an inspection of the detailed description of the invention and from the appended claims.

BRIEF DESCRIPTION OF THE DRAWINGS

FIG. 12 is a schematic side view of a second embodiment of a thermal printer, in this case a direct thermal, according to the present invention;

FIG. 13 is a rear view of the driven platen roller, stripper belts, and second roller of the printer of FIG. 12;

FIG. 14 is a top plan view of an exemplary web of linerless labels being unwound from the roll of the printer of FIG. 12 and showing registration marks thereon;

DETAILED DESCRIPTION OF THE DRAWINGS

Figure 1:
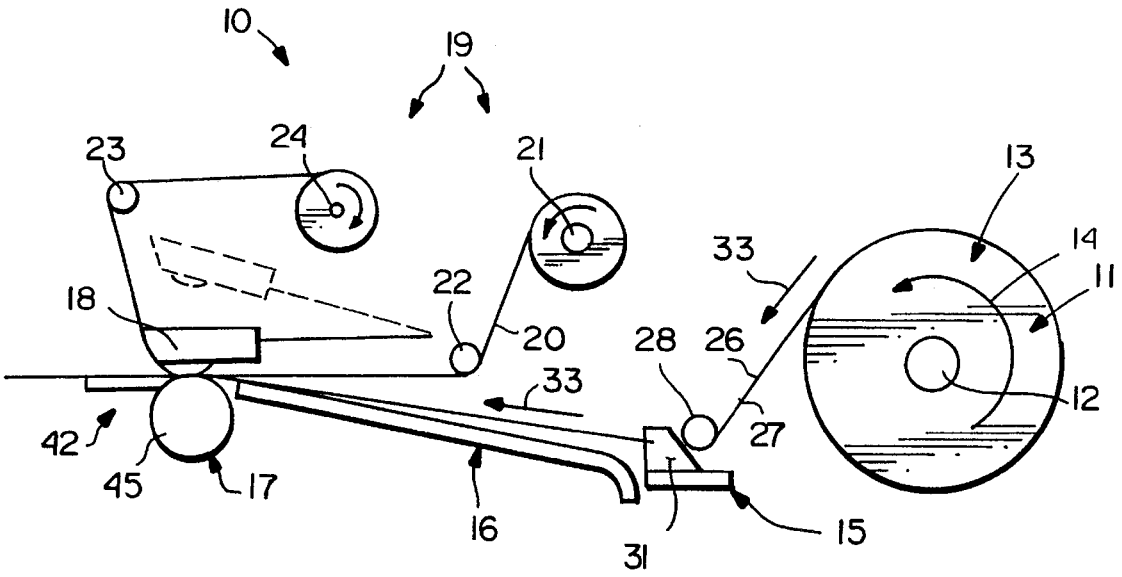
FIG. 1 is a schematic side view of a first embodiment of an exemplary thermal printer according to the present invention, which includes a thermal ribbon unwind and rewind system.

FIG. 1 shows a thermal printer according to a first embodiment of the present invention, generally by reference numeral 10. As is conventional the printer 10 includes a label unwind—shown generally by reference numeral 11 and including a shaft or core 12 which receives a roll of linerless labels 13 thereon, which are taken off when platen roller 17 rotates in the direction of arrow 14 pulling or advancing labels off rolls 13 as illustrated in FIG. 1. As also conventional the printer 10 includes a label guide 15, a transport plate 16, a driven platen roller 17, and a thermal printhead 18. A thermal ribbon unwind/rewind system is associated with the printhead as shown generally by reference numeral 19 in FIG. 1, guiding a thermal ribbon 20 between the printhead 18 and the driven platen roller 17. The printhead 18 is mounted for movement between an engaged, solid line position illustrated in FIG. 1, and a disengaged, dotted line, position in FIG. 1. The thermal ribbon system 19 includes an unwind shaft 21, a pair of idler rollers 22, 23, and a rewind shaft 24 which preferably is driven.

The labels on roll 13 which are to be printed using the printer 10 include a first face 26 which will typically be printed with variable information, and an uncovered adhesive face 27. The adhesive on the face 27 may be permanent adhesive, removable adhesive, or repositional adhesive, depending upon the ultimate use for the labels.

While the printer components described heretofore are conventional per se, including the conventional small idler roller 28, according to the present invention the particular construction of the components is different than in the prior art and is specifically designed to facilitate printing of linerless labels.

Figure 3:
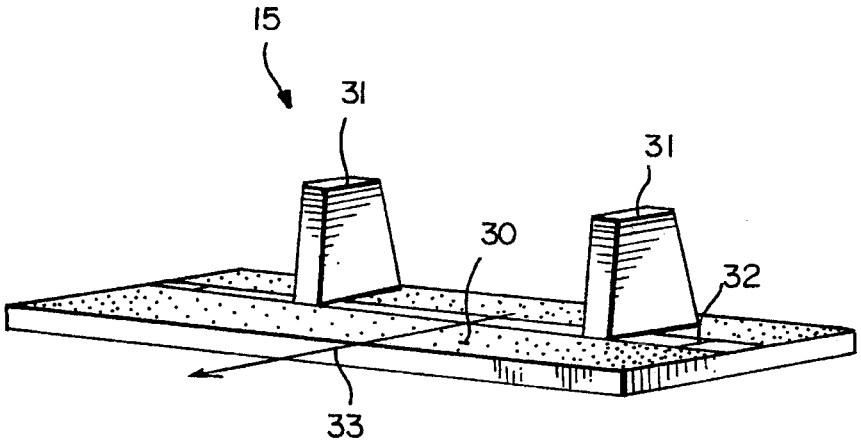
FIG. 3 is a top perspective view of the label guide of the printer of FIGS. 1 and 2.

The label guide 15 according to the present invention is seen most clearly in FIG. 3 and includes a guide surface 30 thereof, as well as a pair of ears 31. The placement of the ears 31 on the guide surface 30 may be adjusted to accommodate labels of different widths, as by moving them in the track 32 formed in the surface 30 perpendicular to the normal direction of movement 33 of the labels. According to the present invention the surface 30—which will engage the adhesive of the adhesive face 27 of the linerless labels 13 during use—is a non-stick surface, preventing sticking of the adhesive from the face 27 to the label guide 15. The surface 30 preferably comprises a plasma coating. Exemplary plasma coatings that are particularly suited according to the present invention are plasma coatings 915 and 936, both being very high release, low friction coatings, and available from Plasma Coatings of Waterbury, Conn. The same plasma coating is preferably utilized for all of the substantially stationary (i.e. not movable during use, although adjustable or repostional) surfaces of the printer 10 which may engage the adhesive of the face 27.

Figure 4:
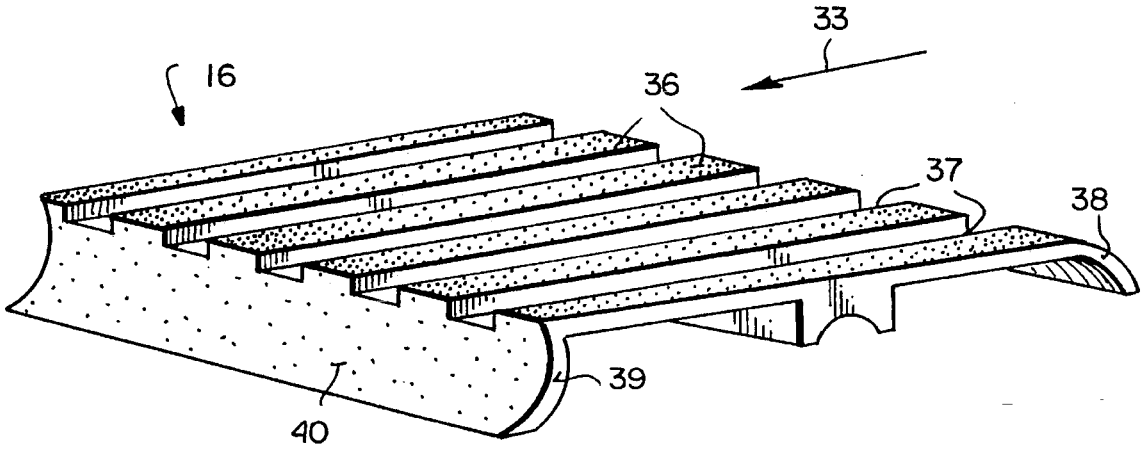
FIG. 4 is a top perspective view of the transport plate of the printer of FIGS. 1 and 2.

The transport plate 16 is seen most clearly in FIG. 4. Not only is the primary surface 36 thereof which guides the adhesive face 27 of the linerless labels plasma coated, but also to enhance the non-stick characteristics of the transport plate 16 even further. A plurality of grooves 37 are formed (e.g. milled) in the surface 36 so as to reduce the surface area which contacts the adhesive face 27. A plasma coating 36 is also preferably provided on the downturned upstream portion 38 of the transport plate 16, and the transport plate 16 also can have a downstream arcuate portion 39 which also is plasma coated, as indicated by the coating 40 in FIG. 4.

The printer 10 according to the present invention, different than conventional thermal printers, also preferably comprises a stripper blade/bridge—shown generally by reference numeral 42 in FIGS. 1, 2, 5, and 6. In a conventional thermal printer for lined labels, a tear bar 43 (see FIGS. 2 and 6) is provided just on the opposite side of the driven platen roller 17 from the label guide 15, but conventional thermal printers do not have the problem of the labels possibly sticking to the platen roller 17 and being wound up thereon. The stripper blade/bridge 42 prevents this problem, being mounted— as seen most clearly in FIG. 5—so that the preferably pointed tip 44 thereof just barely touches or is very slightly spaced from the peripheral surface 45 of the driven platen roller 17. Blade/bridge 42 thus prevents the leading edge 47 of the label 48 from continuing with the rotating surface 45 after thermal printing by the printhead 18, the adhesive face 27 of the label 48 instead passing onto the upper plasma coated surface 50 of the stripper blade/bridge 42 and guides the label either out to the operator or into the cutter. It is convenient to mount the stripper blade/bridge 42 directly onto the pre-existing tear bar 43, e.g. by welding it, gluing it, or attaching it to the tear bar 43 with removable (and/or adjustment-allowing) fasteners. The stripper blade/bridge can also be mounted to the lower anvil blade of the cutter.

Figure 5:
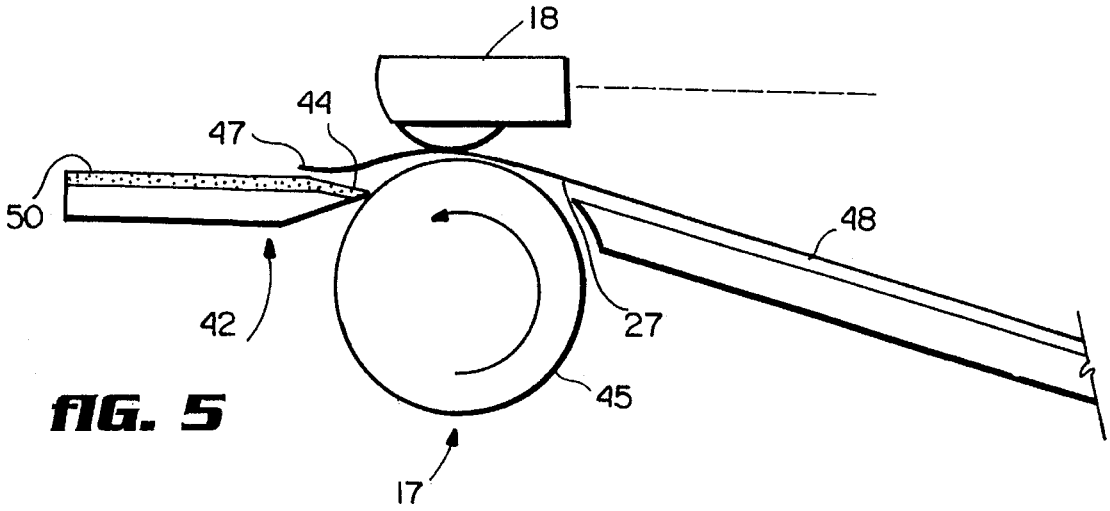
FIG. 5 is a detail side schematic view illustrating the cooperation between the stripper blade/bridge and the driven platen roller and a linerless label being printed, of the printer of FIG. 1.
Figure 6:
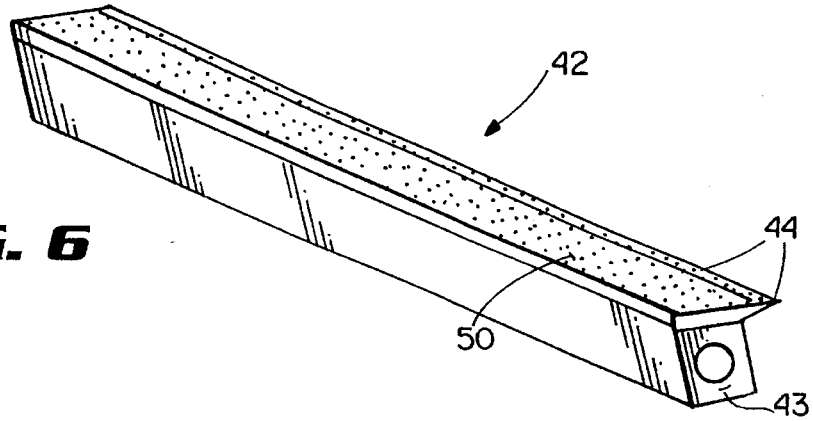
FIG. 6 is a top perspective view of the stripper blade/bridge of the printer of FIGS. 1 and 5.
Figure 7:
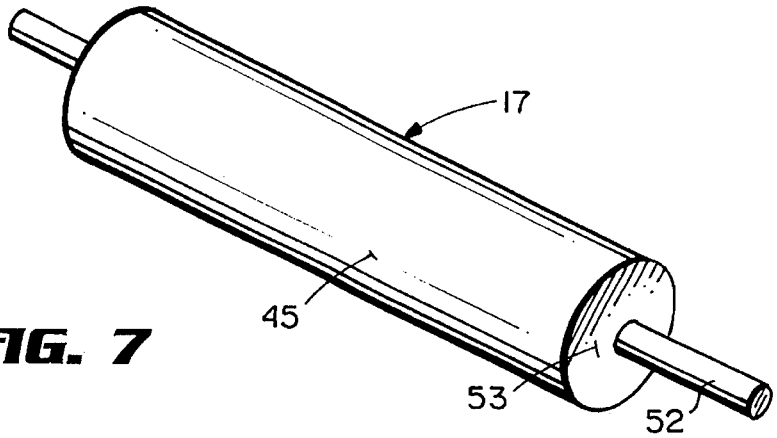
FIG. 7 is a top perspective view of the driven platen roller of the printer of FIGS. 1, 2, and 5.

Also according to the present invention the driven platen roller 17—as seen most clearly in FIGS. 1, 5, and 7—may preferably comprise a steel inner shaft 52 (which may be connected to a conventional drive motor by a gear arrangement, sprocket and chain drive, drive belt assembly, or the like). Disposed on the shaft 52 so preferably is a roller 53, with the external periphery 45 of the roller 53 coated with a non-stick coating, or otherwise provided with a non-stick configuration so that the adhesive on the adhesive face 27 of a label 48 will not readily stick to the surface 45. While a plasma coating as described earlier may be utilized if the roller 53 is metal, preferably according to the present invention the non-stick coating on the periphery 45 is a high release silicone rubber coating that has high friction characteristics in addition to high release (non-stick) characteristics. Whereas the plasma coating provides a low friction, the silicone rubber provides high friction, which facilitates drive of the label 42, unwound from the roll 13, due to engagement thereof by the driven platen roller 17. Commercially available silicone rubber covering or coating that may be provided according to the present invention are silicone HiRel 2609 and 2605 from Silicone Products and Technology Inc. of Lancaster, N.Y. When provided as a coating it is merely on the surface of the roller 53, and when provided as a covering it comprises the entire roller 53 mounted on the shaft 52 (see FIG. 7).

Figure 11:
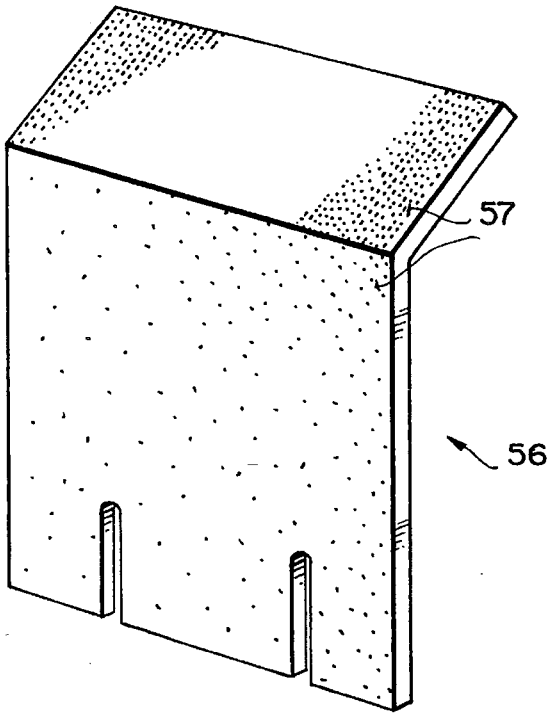
FIG. 11 is a top perspective view of the front panel of the printer of FIG. 2.

The printer 10 also includes a front panel 56 which is different than a conventional front panel for a printer. The front panel 56—shown in FIGS. 2 and 11— has an outer surface thereof which is plasma coated as indicated by reference numeral 57 in FIGS. 2 and 6. The plasma coating 57 is provided since—if the optional cutter illustrated generally by reference numeral 60 in FIGS. 2 and 8 is not provided— the panel 56 is likely to have the adhesive face 27 come in contact therewith after printing.

Figure 2:
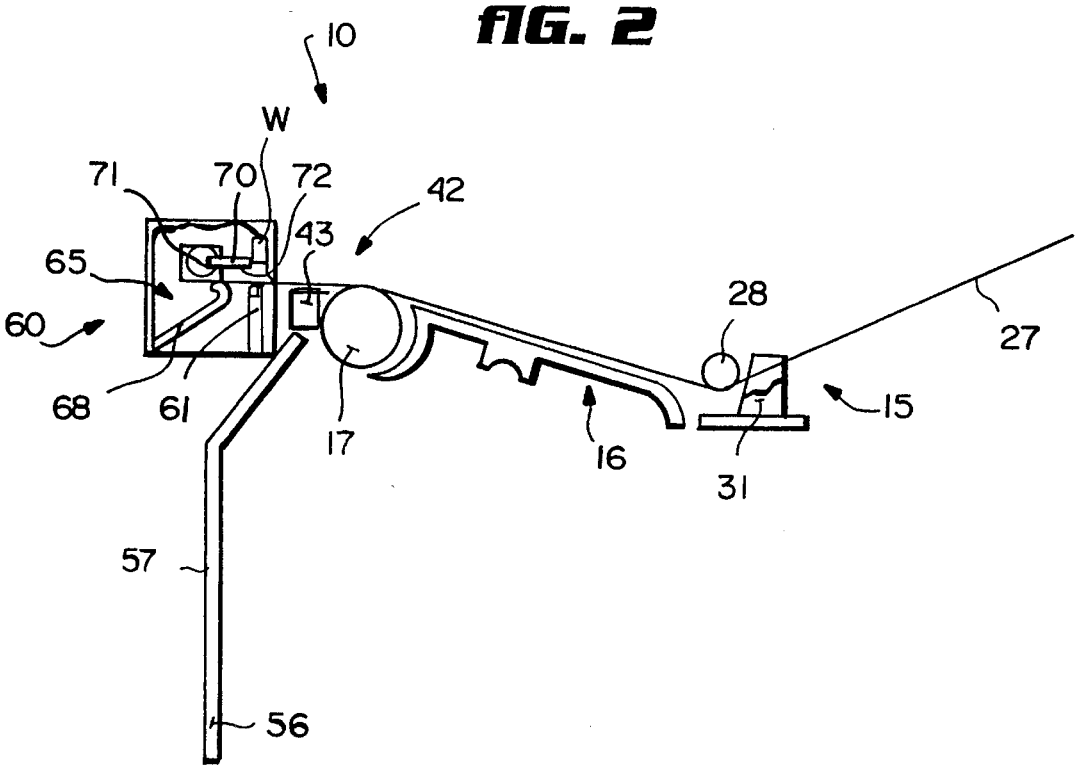
FIG. 2 is a detail view of some of the components of the embodiment of FIG. 1, and also showing a front panel and an optional cutter.
Figure 8:
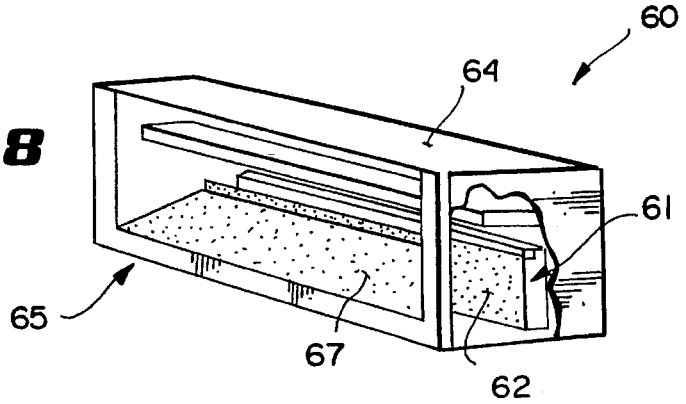
FIG. 8 is a top perspective view, with portions cut away for clarity of illustration, of the cutter of the printer of FIG. 2.
Figure 9:
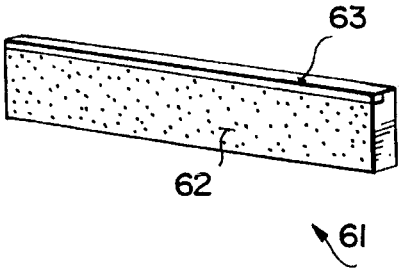
FIG. 9 is a top perspective view of the anvil of the cutter of FIG. 8.

The optional cutter 60 is seen in FIGS. 2 and 8 and is provided to sever the web of the roll 13 into individual labels 48, in which case perforations and sense mark need not be provided in the web forming the roll 13. As seen in FIGS. 2, 8 and 9, one of the major components of the cutter 60 comprises an anvil 61 having a plasma coated surface 62 thereof and a hardened blade portion 63 which is not plasma coated. The anvil 61 is mounted within the housing 64 (see FIG. 8) so that the linerless label will pass over the blade 63.

Figure 10:
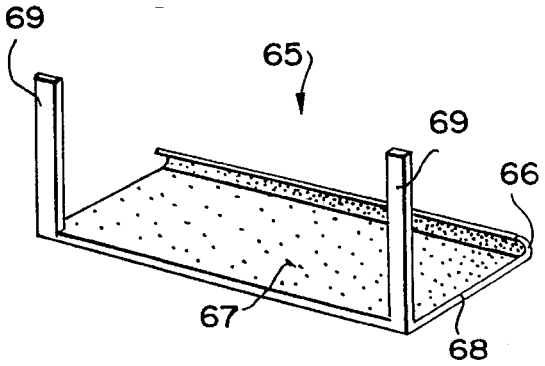
FIG. 10 is a top perspective view of the exit plate of the cutter of FIG. 8.

Downstream of the blade 63 in the housing 64 is the exit plate 65 (see FIGS. 2, 8 and 10). The exit plate 65 includes an upstream arcuate portion 66 having all surfaces thereof plasma coated, as indicated by the plasma coating 67, and a slanted substantially planar body portion 68 also covered by the plasma coating 67. The upstanding legs 69 may be provided to facilitate mounting of the exit plate 65 in the housing 64.

As seen only schematically in FIGS. 2 and 8, the cutter 60 also includes a movable cutter blade 70, mounted on the shaft 71 which is journalled in the housing 64—having a cutting edge 72 thereof which comes into contact with the hardened blade 63 of the anvil 61 to effect cutting when the blade 70 is rotated about a generally horizontal axis extending through the shaft 71. A felt wiper W impregnated with silicone oil can be added to the cutter to lubricate and clean the cutter blades. The wiper enhances the number cut before cleaning is required. As the cutter rotates the blade, it wipes against the felt wiper. Rotation may be accomplished by any suitable powered mechanism which merely rotates the blade 70 downwardly and then after the cutting arc is completed rotates back upwardly.

The embodiment illustrated in FIGS. 12 through 14 is slightly different than that of FIGS. 1 through 11. The embodiment of FIGS. 12 through 14 is more typically utilized for direct thermal printing of a thermal linerless label web shown generally by reference numeral 74 in FIGS. 12 and 14, and having a thermal face 75 and an adhesive face 76, with registration (sensor) marks 77 disposed thereon in spaced locations in the direction of movement 73 of the web, the registration marks 77 spaced a distance corresponding to a label length (print length).

In the printer 79 of FIG. 12, a label unwind is provided by a conventional mechanism, such as a hub 80 which is spring mounted by the spring 81. The linerless label web 74 forms a roll 82 around the hub 80. The adhesive face 76 of the web 74, when moving in the direction 73, first passes over the exterior surface 83 of an idler roller 84. Then the web 74 moves past a sensor (e.g. an optical sensor) 85 to the driven platen roll 86, similar to the roll 17 in the FIG. 1 embodiment. FIG. 12 schematically illustrates a drive motor 87 which drives the roller 86 by a gear, sprocket, or pulley arrangement, as indicated schematically by sprocket 88 connected to the mounting shaft 89 for the platen roller 86, and the chain 90. The driven platen roll 86 cooperates with a conventional direct thermal print head 91.

Downstream of the printhead 91 and platen roller 86 in the direction of web 74 movement 73, a tear off bar 90' is provided. The tear off bar 90' preferably is metal, and is plasma coated as heretofore described. In this embodiment, in order to prevent label web 74 from wrapping around the platen roll 86 stripper belts 91' (see FIGS. 12 and 13) and a second roller 92 (preferably an idler roller) are provided. The second roll 92 has surface manifestations thereon, such as the O-rings 93, which also preclude sticking of the adhesive face 76 of the web 74 thereto, and thus facilitate movement of the web 74 past the printhead 91 in the direction 73.

The platen roll 86 may be the same as the roller 17 earlier described including having the silicone covering or coating. Also the rolls 92, 83 are preferably made in the same manner (with a silicone coating or covering), and a silicone rubber forms or coats stripper belts 91' and the O-rings 93. The HiRel 2609 or HiRel 2605 silicone rubber earlier described is suitable for all these purposes. The stripper belts 91' are disposed in grooves 94 formed in the surface of the driven platen roll 86 so as to not interfere with the printing action. The O-rings 93 may under some circumstances actually facilitate good thermal contact between the printhead 91 and the web 74 passing over the driven platen roll 86.

Note that the sensor 85 is operatively connected to the drive motor 87—as indicated by dotted line 95 in FIG. 12. As the marks 77 are sensed by the sensor 85, the drive motor 87 is stopped until a label is torn off at the tear bar 90'. Then a suitable actuator (not shown) is actuated to again operate the motor 87 to provide advancement of the web 74 one label length until the sensor 85 again senses the registration marks 77.

Figure 15:
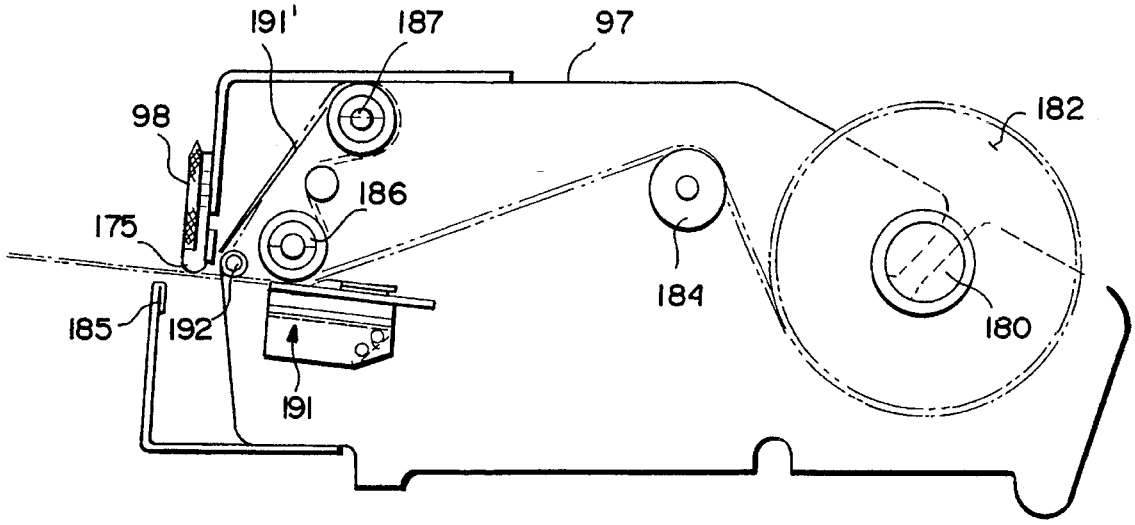
FIG. 15 is a view like that of FIG. 12 of another embodiment of a direct thermal printer according to the present invention.
Figure 16:
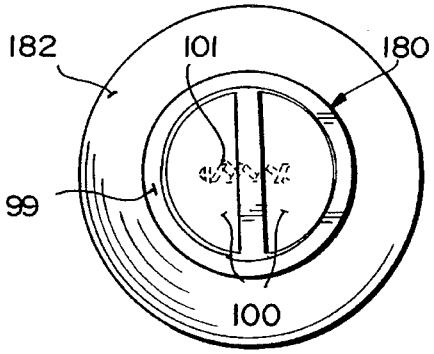
FIG. 16 is a detail side view of the label unwind roll of the printer of FIG. 15.
Figure 17:
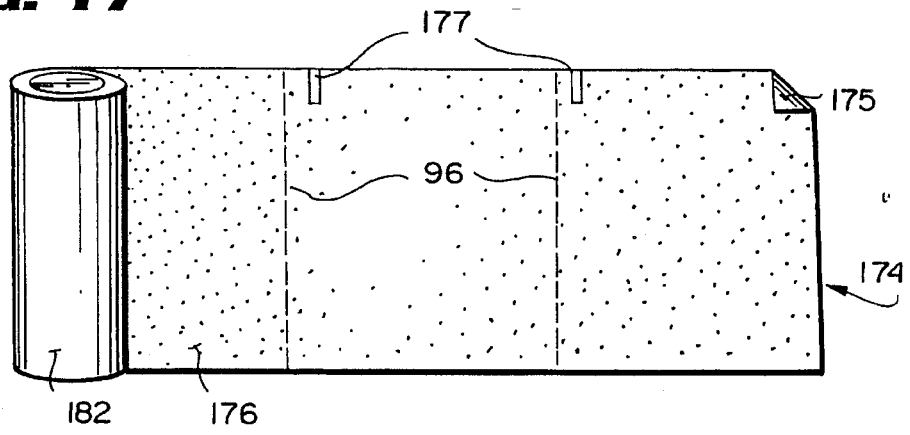
FIG. 17 is a view like that of FIG. 14 showing the adhesive side of an exemplary web of linerless labels, of a label roll, and showing the registration marks and perforations thereof.

In the FIGS. 15 through 17 embodiment components comparable to those in the FIGS. 12 through 14 embodiment are shown by the same reference numeral only preceded by a "1". In this embodiment the web of labels 174 have preformed lines of weakness (perforations) 96, and the relative orientation between the tear off surface 190', second roll 192, sensor 185, printhead 191, and the like are different. Also the idler roller 184, since it does not engage the adhesive face 176 of the label web 174, need not be covered with a non-stick coating (although the printer roller 186 is). While the tear off surface 190' is located exteriorly of the housing 97, it is plasma coated, including having a plasma coated extension 98. The stripper belts 191' also take a different path, and because of the particular juxtaposition of the tear off surface 190' and the second roller 192 wrap around of the label web 174 is precluded.

Also as illustrated in FIG. 16, the hub 180 configuration is different than in the FIG. 12 embodiment. The label roll 182 includes an interior core 99 (e.g. of cardboard), and the hub 180 includes two plastic hub halves 100, with a plurality of coil compression springs 101 disposed therebetween and pressing them outwardly into engagement with the roll core 99.

The operation of the FIGS. 15 through 17 embodiment is similar to that of the FIGS. 12 through 14 embodiment. The sensor 185, when it senses the registration marks 177, stops the motor 187 which drives the printer roller 186. When the motor 187 stops the operator grasps the web 174 and tears off a printed label, the sensor 185 positioned so that the perforation line 96 is at the plasma coated tear off surface 190'. The plasma coated surface extension 98 prevents sticking of the label to the front of the housing 97. Then the operator actuates a switch (not shown) which starts the motor 187 again, which again drives the printer roller 186 to take off the web from the roll 184 until the next registration mark 177 is sensed.

It will thus be seen that according to the present invention an advantageous printer, particularly a thermal printer, for linerless labels has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims to encompass all equivalent structures and devices.

What is claimed is:

1. A linerless label printer comprising:

a linerless label unwind;

a substantially stationary label guide;

a substantially stationary transport plate;

a rotatable driven platen roller;

a print head cooperating with said platen roller; and said label guide and transport plate having surfaces which engage the adhesive face of linerless labels from said label unwind, said adhesive-engaging surfaces comprising plasma coated surfaces which substantially prevent the label adhesive from adhering thereto.

2. A printer as recited in claim 1 wherein said platen drive roller comprises a peripheral surface which has high release, high friction characteristics so that it will not adhere to the linerless label adhesive and will dry labels when in contact therewith.

3. A printer as recited in claim 2 wherein said peripheral surface of said platen roller comprises a high release silicone covering.

4. A printer as recited in claim 1 further comprising additional substantially stationary surfaces for engaging the adhesive portion of said labels, said additional surface portions also having a plasma coating preventing adherence of the adhesive thereto.

5. A printer as recited in claim 4 wherein one of said additional substantially stationary surfaces comprises a stripper plate/bridge positioned with respect to said platen roller so as to ensure that a label printed by said printhead does not stick to said platen roller after printing but rather is driven away from said platen roller and transported to either the operator or into a cutter.

6. A printer as recited in claim 5 further comprising a tear bar, and wherein said plasma coated strip or blade is mounted on top of said tear bar.

7. A printer as recited in claim 5 wherein said additional surfaces further comprise a cutter including an exit plate and an anvil; and wherein said anvil includes a hardened blade which is not plasma coated.

8. A printer as recited in claim 5 wherein said additional substantially stationary surfaces include a front panel disposed below and extending away from said stripper plate/bridge and said platen roller and having a front surface, said front surface being plasma coated.

9. A printer as recited in claim 1 wherein said transport plate plasma coated surface is grooved so as to reduce the surface area in contact with the adhesive of linerless labels.

10. A printer as recited in claim 1 further comprising a plasma coated non-stick surface stripper plate/bridge positioned with respect to said platen roller so as to ensure that a label printed by said printhead does not stick to said platen roller after printing but rather is driven away from said platen roller.

11. A printer for linerless labels having an uncovered adhesive face, comprising:

a label unwind for mounting a roller of linerless labels;

a driven platen roller having a peripheral surface constructed so that it will not stick to adhesive from the linerless label adhesive face;

a printhead cooperating with said platen roller and disposed on the opposite side thereof from a linerless label printed thereby; and a tear off bar disposed on the opposite side of said platen roller from said label unwind, said tear off bar having a surface which will not stick to the adhesive a linerless label torn off thereby.

12. A printer as recited in claim 11 wherein said tear off bar nonstick surface comprises a plasma coating.

13. A printer as recited in claim 11 wherein said driven platen roller comprises a peripheral surface which has high release, high friction characteristics so that it will not adhere to the linerless label adhesive and will drive labels when in contact therewith.

14. A printer as recited in claim 11 further comprising a plurality of stripper belts and a second roller with stripper manifestations formed thereon, cooperating with said platen roller and on the opposite side thereof from said label unwind in the path of movement of linerless labels facilitating detachment of a linerless label from said platen roller.

15. A printer as recited in claim 14 wherein said surface manifestations on said second roller comprise a plurality of O-rings.

16. Apparatus as recited in claim 11 further comprising a sensor for sensing a registration mark provided on the linerless labels, said sensor operatively connected to drive said platen roller to control the operation of said driven platen roller in response to sensing of said registration marks.

17. A printer as recited in claim 11 wherein said printhead comprises a thermal printhead.

18. A printer as recited in claim 1 wherein said printhead comprises a thermal printhead.

19. Apparatus as recited in claim 18 further comprising a thermal ribbon unwind and rewind assembly for providing feed of a thermal ribbon between said printhead and said platen roller.

20. A thermal printer for linerless labels having an uncovered adhesive face thereof, comprising:

a label unwind;

a label guide;

a transport plate;

a driven platen roller;

a thermal printhead cooperating with said driven platen roller to thermally print linerless labels passing therebetween; and a stripper blade on the opposite side of said platen roller from said label unwind in the path of movement of linerless labels for ensuring that labels printed by said thermal printhead will not wrap around said platen roller but will be moved away from said driven platen roller as said driven platen roller is rotated, said stripper blade having a label adhesive face engaging surface thereof which comprises a non-stick surface which will not adhere to a linerless label adhesive.

* * * * *